United States Patent [19]

Bourcier et al.

[11] 4,378,054

[45] Mar. 29, 1983

[54] TAPHOLE OPENING APPARATUS FOR BLAST FURNACES

[75] Inventors: Jean-Pierre Bourcier, Lamarche; André Menou, Aulnay, both of France

[73] Assignees: Atlas Copco France S.A., Franconville; Maurice Bourcier S.A., Lamarche, both of France

[21] Appl. No.: 183,804

[22] Filed: Sep. 3, 1980

[30] Foreign Application Priority Data

Sep. 5, 1979 [FR] France ..... 79 22167

[51] Int. Cl.[3] ..... B25D 9/06; B25D 17/08; B23B 41/00

[52] U.S. Cl. ..... 173/29; 173/48; 173/132; 173/133; 266/272

[58] Field of Search ..... 173/31, 32, 38, 48, 173/132, 133, 29; 266/272

[56] References Cited

U.S. PATENT DOCUMENTS

| | | | |
|---|---|---|---|
| 273,443 | 3/1883 | Bittenbender et al. | 173/32 |
| 911,755 | 2/1909 | Pfouts | 173/48 |
| 1,055,594 | 3/1913 | Arnott | 173/133 X |
| 1,595,064 | 10/1926 | Barrett | 173/48 |
| 1,977,645 | 10/1934 | Roberts | 173/133 X |
| 2,035,156 | 3/1936 | Hale | 173/132 X |
| 2,293,443 | 8/1942 | Mossberg | 173/132 X |
| 3,845,826 | 11/1974 | Beisch | 173/48 |
| 4,057,234 | 11/1977 | Brücher et al. | 266/272 |

FOREIGN PATENT DOCUMENTS

| | | | |
|---|---|---|---|
| 704014 | 3/1941 | Fed. Rep. of Germany | 173/32 |
| 2339395 | 2/1975 | Fed. Rep. of Germany | 173/132 |
| 863775 | 1/1941 | France | 173/32 |

*Primary Examiner*—W. Carter Reynolds
*Attorney, Agent, or Firm*—Eric Y. Munson

[57] ABSTRACT

The operator of a taphole drilling apparatus for blast furnaces performs manual changes on the apparatus in its safe position of rest and operation by remote control and automatic latching in hazardous taphole work including drilling and subsequent driving, release, and extraction of a tap bar. The usual guide rail (22) carrying reciprocably a hammer drill (30) thereon incorporates a remotely openable automatically latching centralizer (42) at its forward end and an extraction carriage (29) on which, after removal of the drill steel (43), an impact sleeve (50) can be manually mounted for being impacted by the hammer drill (30). In one mounting position (FIG. 5) of the impact sleeve (50), a latch (57) therein is biased to automatically latch the shank of a tap bar (53) thereto for extraction by impacts. In a 180° counter-turned position the latch (57) will fall aside and the mounted sleeve (50) is used to drive the tap bar while guided by the centralizer (42). The sleeve (50) can then be retracted freely from the tap bar (53) and the guide rail (22) freed by unlatching the centralizer (42) from the tap bar (53).

6 Claims, 13 Drawing Figures

TAPHOLE OPENING APPARATUS FOR BLAST FURNACES

Up to now taphole opening for the smelt from blast furnaces or other metallurgical ovens was performed according to the classical method of drilling through the plugging mass by a percussive and rotary drilling machine. According to one prior alternative a drill steel is actuated by a hammer drill to drill an initial part of the hole and the hole is subsequently completed by an oxygen lance or by the use of a consumable poking bar manually to crush through the remaining plugging so as to open hole for the molten metal. According to another prior alternative the taphole can be drilled in one single operation by means of an expendable tubular drill steel tool driven by a hammer drill through the plugging into the molten metal for opening up as described for example in the French Pat. No. 2093292.

A different technique is now beginning to be utilized. It consists of drilling immediately after plugging a hole of a length of about two thirds of the thickness of the blast furnace wall into the still fresh plugging mass directly after such drilling piercing through by force the remaining third of the fresh mass by a steel bar until it reaches the molten iron and acts as a closing plug in the plugging mass for the metal while extending outwardly through the mass into the runner trench. The steel bar is left in such plugging position and presents at its free extremity suitable coupling means. Later at the tapping instant a device able to produce a rapid extraction is then coupled to and withdraws said bar so as to de-plug or to open the taphole and to permit the molten iron to run out into the runner trench. The plugging bar is regarded being consumable and is hereinafter therefore called lost bar.

There are machines on the market which permit realization of this succession of steps but necessitate in the first place the use of special bidirectionally percussive hammer drills with a separate rotation motor that can be shut off. These machines are thus able to produce impact action to the rear in the extracting sense without rotary movement, and demand manual intervention for coupling the tap bar left in the hole to the extraction device fixed on the tapping apparatus which preferably may be brought into a retracted position of rest for leaving free the runner for repair purposes after a preceding tapping. The use of double impact and separate rotation hammer drills obviously is cumbersome and expensive, while manual coupling near the taphole runner trench is hazardous for the operator. Furthermore, two operators are necessary for these operations, one at the control stand of the machine and the other in the vicinity of the tapping hole.

As a consequence, the main object of the invention is to present for the aforementioned recently introduced different technique a more economic and more safe taphole opening apparatus adaptable to existant tapping machines and in particular relying on impact sleeve means of an improved construction.

In the appended drawings

Figure 1:
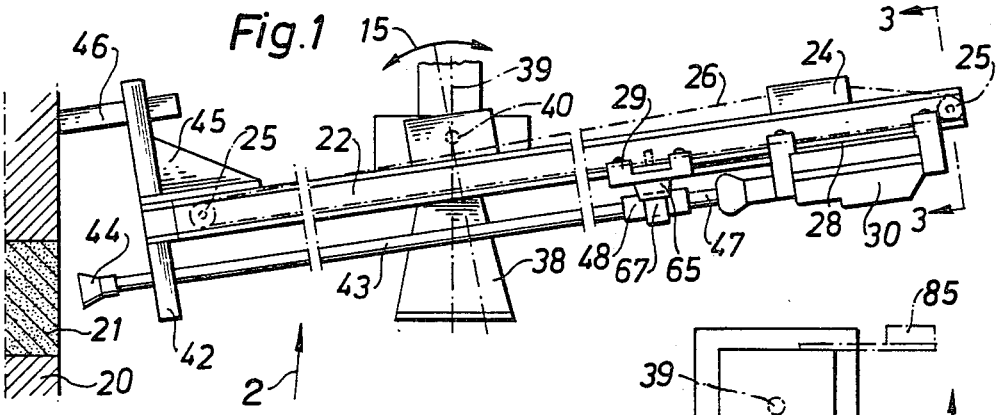
FIG. 1 is a diagrammatic side view of the taphole opening apparatus according to the invention in position for drilling an initial hole into a blast furnace wall.
Figure 2:
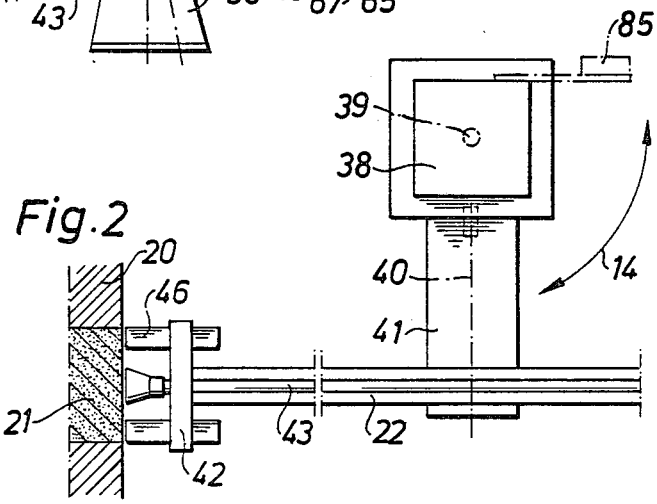
FIG. 2 is a bottom view in the direction of arrow 2 in FIG. 1 and indicates diagrammatically the supporting standard forming part of the apparatus.
Figure 3:
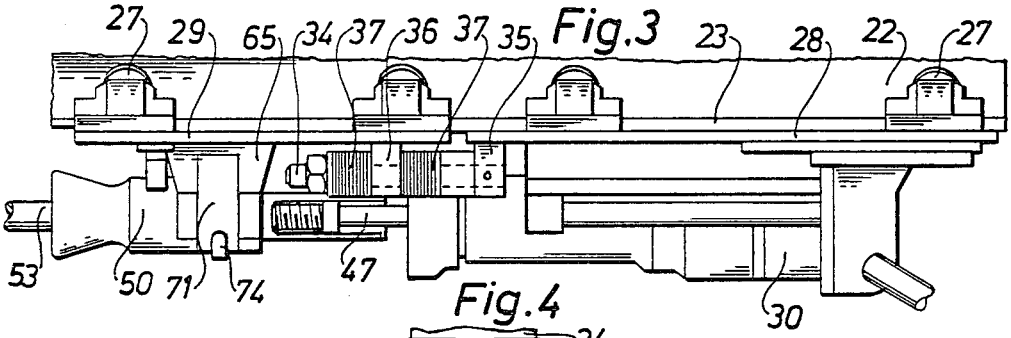
FIG. 3 is an enlarged view on the line 3—3 in FIG. 1.
Figure 4:
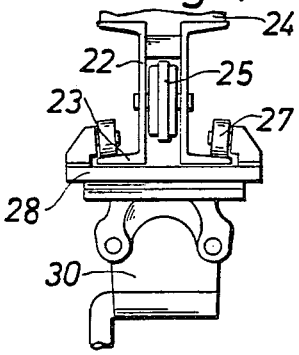
FIG. 4 is an enlarged side view of the hammer drill in FIG. 1 mounted for extracting a tap bar.
Figure 5:
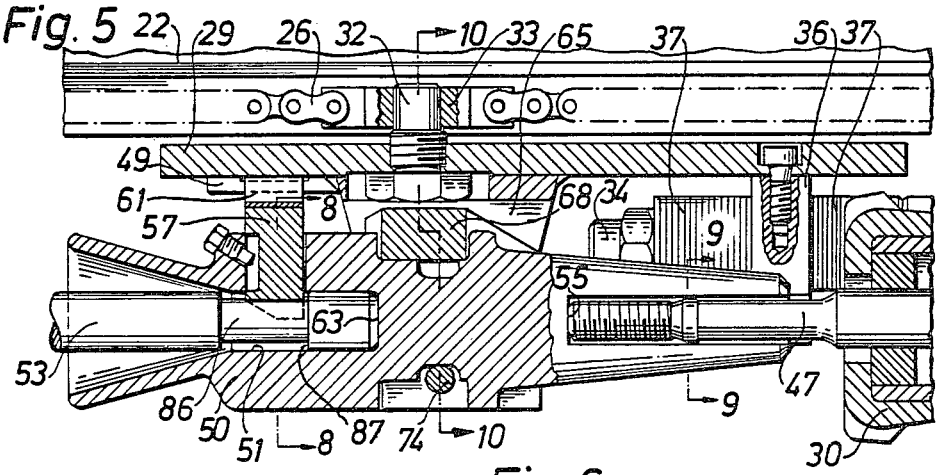
FIG. 5 is a partial section on an enlarged scale showing the extractor carriage and impact sleeve of FIG. 4 in position for extracting a tap bar.

In FIGS. 1 and 2 a taphole opening apparatus incorporating the invention is shown in working position adjacent the wall of a blast furnace 20 into the freshly applied plugging mass 21 of which there is first to be drilled an initial tapping hole and then driven a tap bar or lost bar 53 (FIGS. 3,5) all through the mass as a continuation of the initial hole. Along a guide rail 22 a carriage 28 can be displaced to and fro under the action of a feed motor 24 and a feed chain 26 laid over spockets 25. As shown in FIGS. 3 and 4 the carriage 28 is suspended movably on and along opposed flanges 23 on the guide rail 22 by a number of pairs of opposed rollers 27. The carriage 28, FIGS. 4 and 5, is preferably divided into a front portion, the extractor carriage 29 and a rear portion, the drill carriage 28 proper, the latter carrying a conventional preferably compressed air driven hammer drill 30 having the usual built-in drill rotation means, not shown. The feed chain 26 is, via a shackle 33 and a drive bolt 32 (FIG. 5) received therein, in driving connection with the extractor carriage 29 which in its turn is connected to the drill carriage 28 by side bolts 34 (FIG. 3) fixed to a lug 35 formed on the drill carriage 28 and passing through an ear 36 on the extractor carriage 29 interposed between a pair of vibration damping Belleville-spring packages 37 under suitable compression.

The guide rail 22 is mounted on a standard 38 and a transverse arm 41 so as to be turnable as indicated by arrow 14, FIG. 2, about a vertical axis 39 between a turned away position of rest, not shown, and the working position indicated in FIGS. 1 and 2 and back again, and tilted by arm 41 about a horizontal axis 40 as indicated by arrow in FIG. 1 between a horizontal position of rest and the inclined working position shown in FIG. 1. At the forward end of the guide rail 22 there is mounted a centralizer 42 for either a drill steel 43 having a bit 44 thereon or for the tap bar 53, FIGS. 3, 5. The tap bar 53 has a reduced diameter shank portion 86 thereon providing a rear shoulder 87.

A bracket 45 is affixed to the guide rail opposite to the centralizer 42 and carries spurs 46 for engagement with the wall of the blast furnace 20 while a power cylinder, not shown, may be provided for moving the guide rail 22 longitudinally relative to the standard 38 to attain such engagement. Hammer drill 30 has the usual forwardly protruding shank adaptor 47 to which may be threaded an extension sleeve 48, FIG. 1, in its turn in threaded connection with the drill steel 43. The shank adaptor 47 can alternatively transmit the impacts it receives from the hammer drill 30 to an impact sleeve 50, FIGS. 4, 5, which in FIG. 1 has been removed from the extractor carriage 29 to make room for the extension sleeve 48.

Figure 6:
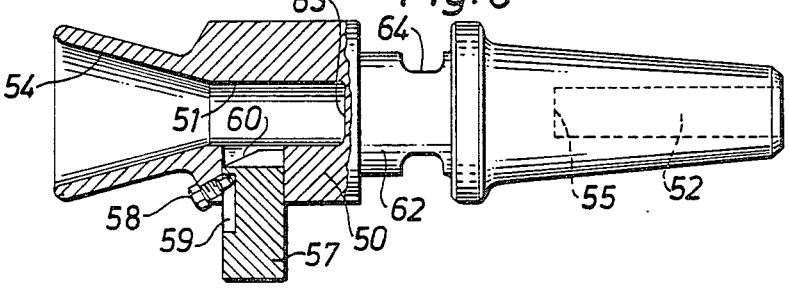
FIG. 6 is a view of the impact sleeve in FIG. 5 in a position for driving the tap bar forwardly.
Figure 7:
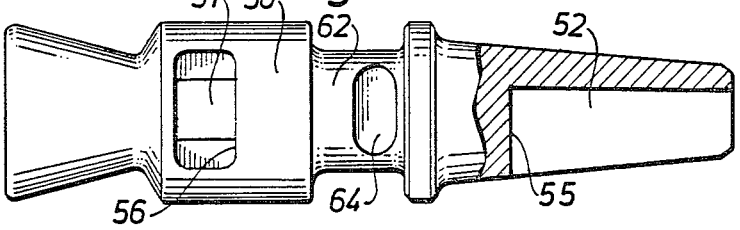
FIG. 7 is a partly sectional top view of the impact sleeve in FIG. 5.
Figure 8:
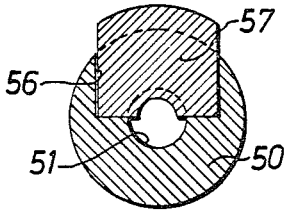
FIG. 8 is a sectional view on line 8—8 in FIG. 5.
Figure 9:
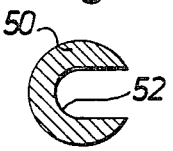
FIG. 9 is a sectional view on line 9—9 in FIG. 5.

The impact sleeve 50, FIGS. 5–7, is provided with two longitudinal axially aligned bores, one of them, socket or bore 51 for receiving the shank of the tap bar 53 and the other, bore 52 for receiving the shank adaptor 47. Socket 51 has an impact transmitting bottom surface 63 and widens conically in outward direction defining a funnel 54 on impact sleeve 50, while bore 52 is open laterally to the exterior of sleeve 50, FIG. 7, so as to allow sidewise introduction of the shank adaptor 47 when impact sleeve 50 is to be mounted on extractor carriage 29. Bore 52 also defines an anvil surface 55 at its bottom. A cross opening 56 receiving slidably a latch 57 therein extends into socket 51, FIG. 8. A stop screw 58 on sleeve 50 cooperates with a groove 59 on latch 57 to prevent it from falling out of the cross opening 56 (FIG. 7) and to allow it to project into socket 51 (FIG. 5). An inclination 60 allows the latch 57 to be pushed aside from such projected position as a result of introduction of the shank of a tap bar 53 into socket 51 to the position indicated in FIG. 5. A downwardly pointing u-shaped leaf spring 61 suspended in brackets 49 on extractor carriage 29 and the weight of latch 57 urges said latch 57 into socket 51 in the position shown in FIG. 5 again in the position of FIG. 6 the weight thereof urges latch 57 out from socket 51. The impact sleeve 50 has a waist 62 of reduced diameter having opposed flattened sides 64.

The extractor carriage 29, throuh which the drive bolt 32 is threaded, carries a u-shaped downwardly directed bracket 65 the sidemembers 66 of which are terminated by rectangular downwardly pointing lugs 67. An impact yoke 68 is received between the members 66 and straddles each terminal lug 66 by pairs of laterally directed projections 69. Outwardly and on each member 66 is affixed an L-shaped angle iron 71 each having a bore 72 adjacent its lower member. These bores 72 are coaxial and in alignment with corresponding bores 73 in the impact yoke 68. A retaining pin 74 may be stuck through the bores 72, 73 thereby locking the impact yoke 68 to the U-bracket 65 and thus to the extractor carriage 29. The yoke 68 is intended for straddling the waist 62 of impact sleeve 50 before insertion of the retaining pin 74, which then selectively extends along either one of the flattened sides 64 of the waist 62 and thereby locks the impact sleeve 50 to the carriage in either one of two positions.

Figure 13:
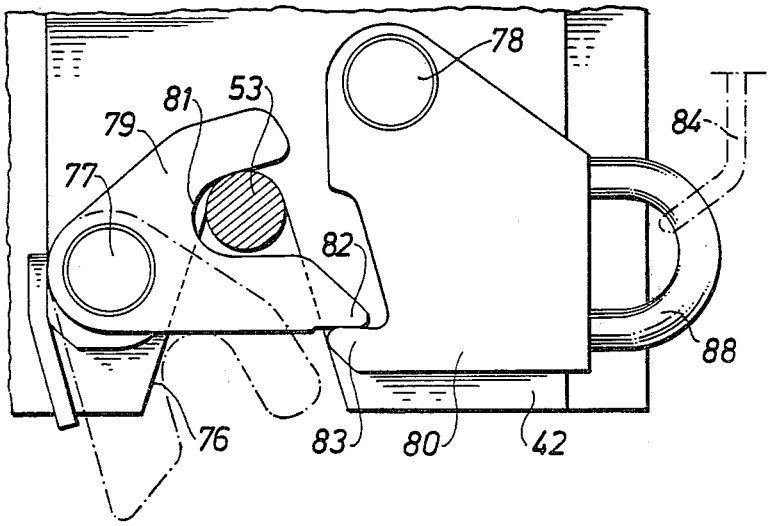
FIG. 13 is a fragmentary view on an enlarged scale of a centralizer forming part of the apparatus.

The centralizer 42, FIG. 13, is provided with a downwardly pointing guide opening 76 of rounded V-shape adjacent to which are affixed two parallel axles 77, 78 about which are pivotable respectively a guide lever 79 and a latch lever 80. The guide lever 79 has a guide opening 81 at the outer end thereof and can either occupy an expelling or catching position illustrated by dash and dot lines in FIG. 13 at the mouth of guide opening 76, or a guiding position shown by full lines and being in alignment with and closing downwardly guide opening 76. Latch lever 80 in this latter position by reason of its weight bias engages the outer end 82 of the guide lever 79 by a lug 83 thereby latching and keeping the guide lever 79 in guiding position. A shackle 88 is affixed to latch lever 80 and is connected to an actuating rod 84 or cable, not shown in detail, that is guided in suitable way along guide rail 22 and standard 38 so as to be remotely actuated from the operator's stand or panel 85 in safe position with respect to the taphole at 21 and the runner trench thereunder, not shown.

Let it be assumed that the guide rail 22 and the elements supported thereby occupy a safe position turned away or retracted from the blast furnace, for example angularly off-set by 90 to 180 degrees with respect to the position shown in FIG. 2. Immediately after plugging the taphole at 21 in the wall of the blast furnace 20 it is necessary to drill an initial hole of certain length into the still fresh taphole plugging mass 21.

To this end and in case impact sleeve 50 still remains affixed in place in extractor carriage 29 after the preceding operation of extracting and removing a tap bar, impact sleeve 50 and yoke 68 are removed and put aside after removal of retaining pin 74. By a conventional threaded extension sleeve 48 the drill steel 43 carrying bit 44 is connected to shank adaptor 47 and set in rotation and impacted by hammer drill 30. As depicted in FIG. 1 the extension sleeve 48 will now occupy a position below extractor carriage 29 and freely spaced between members 66 and lugs 67 of U-bracket 65 thereof. By conventional hydraulic remote control from stand 85 guide rail 22 is then turned about vertical axis 39 of standard 38 to the angular position of arm 41 in FIG. 2 and then inclined by being tilted about axis 40 until the apparatus occupies the position shown in FIG. 1. The initial hole to a depth of about two thirds of the thickness of the mud plug 21 can now be drilled under remote control from stand 85.

Figure 10:
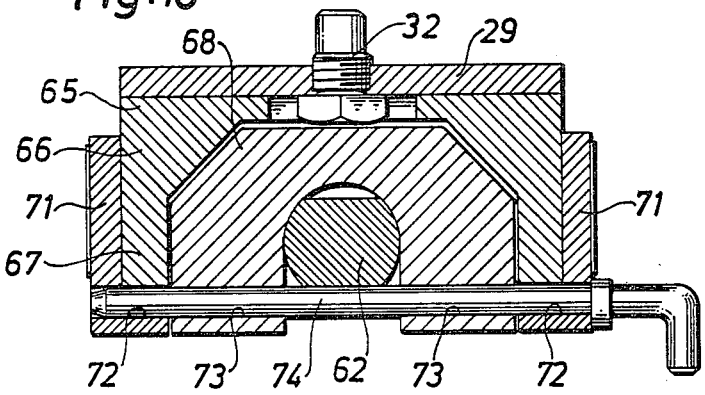
FIG. 10 is a section on line 10—10 in FIG. 5.
Figure 11:
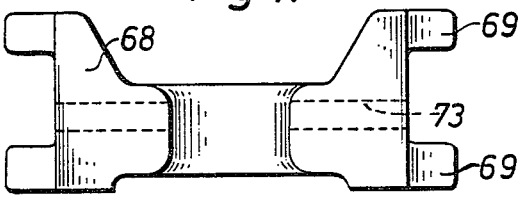
FIG. 11 is a bottom view of an impact yoke shown in FIG. 10.
Figure 12:
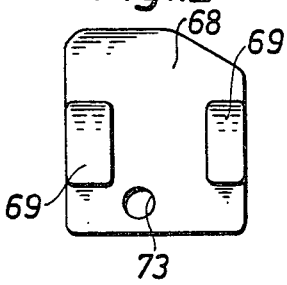
FIG. 12 is a side view of the impact yoke in FIG. 11.

After initial drilling guide rail 22 by arm 41 is returned to a safe angularly off-set position of rest and the extension sleeve 48 is manually disconnected from the shank adaptor 47 together with the drill steel 43 and bit 44. By a vertical upward movement the impact sleeve 50 together with the straddling impact yoke 68 thereon are then positioned in place manually into bracket 65 of extractor carriage 29 with the bore 52 of impact sleeve 50 in a position opposite to FIG. 7 as to be able to receive the shank adaptor 47 of hammer drill 30. The impact sleeve 50 is then manually turned to a position corresponding to FIG. 6 in which the plug 57 leaves the socket 51 by gravitation but is retained by the stop screw 58. The retaining pin 74 is then driven in place into bores 72, 73, FIG. 10, thereby locking impact sleeve 50 and impact yoke 68 to bracket 65 and thus to the extractor carriage 29. The tap bar 53 is then put in place manually by its shank portion being inserted via the funnel 54 into socket 51 of impact sleeve 50. Simultaneously therewith the outer end of tap bar 53 is lifted up into the guide opening 81 of guide lever 79 on the centralizer 42, which lever 79 first occupies the position repesented by dash and dot lines in FIG. 13. The lifting is continued until tap bar 53 is received centrally in the main guide opening 76 at which instant guide lever 79 will be latched by latch lever 80 in the position depicted by full lines in FIG. 13.

By remote control from stand 85 guide rail 22 is then turned about vertical axis 39 of standard 38 so as to face the wall of blast furnace 20 and is then again tilted somewhat downwardly about horizontal axis 40 so as to bring tap bar 53 into alignment with the just pre-drilled initial hole in mud plug 21. Hammer drill 30 can now be remotely actuated and displaced by movement of and together with the extractor carriage 29 along guide rail 22 driving and piercing by percussive action tap bar 53 through the remaining bottom of the initial hole in the mud plug 21 until penetrating into the molten metal in the interior of blast furnace 20. During such driving the shank adaptor 47, rotating due to the built-in rotation of the hammer drill 30, is allowed to rotate freely in bore 52 while pounding the anvil surface 55 therein.

Lost bar 53 is then released from centralizer 42 by remote actuation from stand 85 of latch lever 80, more particularly by drawing the rod 84 (or the actuation cable) connected to shackle 88. Thereafter guide rail 22 is first tilted upwards and then brought back to the position of rest. Tap bar 53 is left to remain in the tapping hole while closing it and keeping it closed in the manner of a valve plug.

Later, when it becomes time to extract tap bar 53 for opening the taphole, impact sleeve 50 after removal of retaining pin 74 is first turned 180 degrees in the yoke 68 and bracket 65 until it occupies the position depicted in FIG. 5 and retaining pin 74 is then reinserted as shown. Guide rail 22 is then again turned and tilted to its working position by remote control from stand 85. Tilting about the horizontal axis 40 results in the tap bar 53 penetrating into the centralizer guide openings 81, 76 and being latched in such position by latch lever 80. By remote actuation from stand 85 of the feed motor 24 extractor carriage 29 is then advanced towards the blast furnace 20 until the shank of tap bar 53 is caught by funnel 54 and directed into socket 51 past the inclination 60 of latch 57 against bottom surface 63 of socket 51. Latch 57 is hereunder lifted aside into cross opening 56 and then falls back under the combined action of its weight and the bias of leaf spring 61 thus locking tap bar 53 at its rear shoulder 87 at the instant when the reduced diameter shank portion 86 aligns with latch 57. By remote actuation of feed motor 24 extractor carriage 29 is moved backwards along guide rail 22 while hammer drill 30 pounds shank adaptor 47, impact sleeve 50 at its anvil surface 55 in bore 52, and the shank of tap bar 57 at impact transmitting bottom surface 63 of impact sleeve 50. As a result tap bar 53 is percussively extracted thereby opening the taphole for the flow of molten iron. Upon the guide rail 22 having been turned and tilted back to its position of rest centralizer 42 can be remotely actuated to release tap bar 53. Impact sleeve 50 can then be disassembled manually for purposes of preparing the taphole opening apparatus for the next identically performed taphole drilling, taphole plugging and subsequent taphole opening cycle.

As evident from the foregoing all manual operations on the apparatus are effected in its position of rest by one operator safely outside the running trench and remote from the tapping hole.

The described positioning machinery incorporating standard 38 can obviously be replaced by other eqvivalent conventional positioning means, for example guide rail hoists or mobile positioners displaceable from one metallurgical oven to another and having adjacent each of them a safe position of rest sufficiently distant from the working position so as to practically avoid accidents.

We claim:

1. A taphole opening apparatus for blast furnaces wherein a guide rail (22) is provided, a drill steel centralizer (42) is affixed to one end of said guide rail (22), a carriage (28) is movable along said guide rail (22) and carries a drill hammer (30) thereon, motor means (24) are provided for moving said carriage and drill hammer to and fro along said guide rail, and a drill steel (43) for drilling an initial tap hole in a plugging mass in the blast furnace is connectable to be rotated and impacted by said drill hammer (30) and guided by said centralizer (42) during initial drilling of a taphole and thereafter withdrawn from the partially-drilled taphole, characterized by an extractor carriage (29) forwardly of said drill hammer and movable along said guide rail (22) in unison with said carriage (28), an impact sleeve (50) carried by said extractor carriage (29) so as to receive impacts but not rotation at one end thereof from said drill hammer (30), a socket (51) at the other end of said impact sleeve (50) for a tap bar (53) insertable axially therein to replace said withdrawn drill steel (43) and to receive impacts from said impact sleeve (50), so as to complete and plug said tap hole, said impact sleeve having a first mounting position (FIG. 6) on said extractor carriage (29), wherein said tap bar (53) is free to move axially in and out of said socket (51), and a second mounting position (FIG. 5) thereon wherein coupling means are active to automatically lock said tap bar (53) to said socket (51) in response to axial penetration thereof into said socket.

2. An apparatus according to claim 1 in which said centralizer (42) comprises a guide opening means (76,81) for guiding alternatively said drill steel and said tap bar therein, latch means (80) for automatically latching said drill steel (43) or said tap bar (53) to be guided in and by said guide opening means (76,81) in response to lateral penetration thereof into said guide opening means, and control means (84) for opening said latch means (80) actuatable at will remotely from said centralizer (42).

3. An apparatus according to claim 2 in which said guide rail (22) is mounted in inverted position with the drill hammer (30) thereon facing downwardly, said guide opening means comprising a downwardly pivotable locking lever (79), and a pivotable latch lever (80) associated therewith for releasably latching said locking lever (79) in locking position (FIG. 13) towards which said locking lever (79) is biased by its weight.

4. An apparatus according to claim 1, in which a funnel (54) is provided around said socket (51) for axially guiding said tap bar (53) thereinto as a result of forward feeding of said impact sleeve (50) along said guide rail (22).

5. An apparatus according to claim 1 in which said coupling means comprises a latch (57) in an opening (56) transverse to said socket (51) which latch in said second position of said impact sleeve (53) (FIG. 5) is adapted to be biased so as to automatically engage a reduced portion (86) on said bar (53) to latch it fast relative to said socket (51), and which in said first position (FIG. 6) is angularly offset relative to said second position and maintained retracted from said socket.

6. An apparatus according to claim 5 in which a laterally open impact yoke (68) is provided on said extractor carriage (29) for releasably receiving in its yoke opening said impact sleeve (50) in said two alternative mounting positions, and a retaining pin (74) and one means (72, 73) for affixing said yoke and impact sleeve together on said extractor carriage (29).

* * * * *